US008859915B2

(12) United States Patent
Chu

(10) Patent No.: US 8,859,915 B2
(45) Date of Patent: Oct. 14, 2014

(54) ELECTRICAL SWITCH

(75) Inventor: Wilson Wai Cheong Chu, Hong Kong (CN)

(73) Assignee: Defond Components Limited, Chai Wan, Hong Kong (CN)

( * ) Notice: Subject to any disclaimer, the term of this patent is extended or adjusted under 35 U.S.C. 154(b) by 284 days.

(21) Appl. No.: 13/407,160

(22) Filed: Feb. 28, 2012

(65) Prior Publication Data

US 2013/0220788 A1 Aug. 29, 2013

(51) Int. Cl.
*H01H 11/00* (2006.01)

(52) U.S. Cl.
USPC ..... 200/18; 200/5 E

(58) Field of Classification Search
USPC ..... 200/5 E, 18, 572
See application file for complete search history.

(56) References Cited

U.S. PATENT DOCUMENTS

| | | | | |
|---|---|---|---|---|
| 6,838,630 | B2 * | 1/2005 | Sasaki | 200/553 |
| 8,466,381 | B2 * | 6/2013 | Galpchian | 200/5 E |
| 2013/0105293 | A1 * | 5/2013 | Chu | 200/5 E |

* cited by examiner

*Primary Examiner* — Renee Luebke
*Assistant Examiner* — Ahmed Saeed
(74) *Attorney, Agent, or Firm* — Leydig, Voit & Mayer, Ltd.

(57) ABSTRACT

An electrical switch has a switch body, actuators, and switch contacts, and at least one moving contact member having first and second ends. Elongate cam sliders extend side-by-side in the switch body, between the actuators and the moving contact member, for sliding lengthwise by the actuators to cause pivotal movement of the moving contact member about the first end such that the second end is moved into and out of contact with at least one of the switch contacts. The first and second ends of the moving contact member lie in a plane extending parallel to the longitudinal extent of the cam sliders, or extend parallel to the length of the cam sliders.

13 Claims, 9 Drawing Sheets

| Slider Blades | Main Switch ON | Sub. Switches ON | Resistors connected |
|---|---|---|---|
| 500A | ✓ | SW1 | R3 |
| 500C, 500D, 500G | ✓ | SW2, SW6 | R4, R8 |
| 500C, 500G | ✓ | SW6 | R8 |
| 500C, 500E | ✓ | SW5 | R7 |
| 500C, 500B | ✓ | SW4 | R6 |
| 500C, 500F | ✓ | SW3 | R5 |
| 500C, 500D | ✓ | SW2 | R4 |
| 500F | × | SW3 | R5 |

ELECTRICAL SWITCH

The present invention relates to an electrical switch.

BACKGROUND OF THE INVENTION

Keyboard switches are a type of electrical switches widely used in electric food processors or blenders to control power on/off and speed and to perform momentary features e.g. a quick chop and/or mix after the appliance has been switched off. Usually the speed control is achieved by connecting different set of motor windings to the power source, or by controlling the motor current. The use of keyboard switches is cost effective way for speed control by mechanical means. As to construction, keyboard switches have a body with a single row of press buttons atop and one or two rows of switch terminals underneath and includes a switching mechanism provided by a set of cam slider blades for making and breaking electrical connection between internal parts of the switch terminals.

In an effort to combat the rise in copper and material costs, it is necessary to simplify the construction of keyboard switches but to maintain the switch performance and current rating.

The invention seeks to provide a new or otherwise improved electrical switch of this kind, whose construction is simpler and production cost lower.

SUMMARY OF THE INVENTION

According to a first aspect of the invention, there is provided an electrical switch comprising a switch body having upper and lower body interiors, a plurality of actuators in the upper body interior, a plurality of switch contacts provided in the lower body interior, and at least one moving contact member having first and second ends and provided in the lower body interior. Included are a plurality of elongate cam sliders extending side-by-side in the switch body between the actuators and said at least one moving contact member for sliding lengthwise by the actuators to act upon and cause pivotal movement of said at least one moving contact member about its first end such that its second end is moved into and out of contact with at least one of the switch contacts to perform switching operation. Said at least one moving contact member has its first and second ends lying on an imaginary plane extending substantially parallel to the longitudinal extent of the cam slider blades.

Preferably, said at least one moving contact member has an intermediate part between its first and second ends, about which intermediate part said at least one moving contact member is to be acted upon by at least one of the cam sliders.

More preferably, said at least one moving contact member is bent about its intermediate part.

More preferably, the intermediate part of said at least one moving contact member comprises a protrusion for acting upon by said at least one of the cam sliders.

Further more preferably, said at least one moving contact member has a generally flat inverted V-shape.

As a preferred arrangement, the second end of said at least one moving contact member is positioned directly above said at least one of the switch contacts for said switching operation.

In a preferred embodiment, said at least one of the cam sliders has a cam part for acting upon said at least one moving contact member, which cam part is arranged to approach and act upon said at least one moving contact member in the same general direction as that in which said at least one moving contact member extends from its first end to its second end.

More preferably, the cam part has an inclined side for approaching and acting upon said at least one moving contact member.

In a preferred embodiment, the electrical switch incorporates a control circuit provided on a circuit board which is fixed to the switch body.

More preferably, the switch contacts are provided on the circuit board and said at least one moving contact member is mounted on the circuit board, the switch contacts and said at least one moving contact member being part of the control circuit.

More preferably, the switch body comprises a switch case and the circuit board, with the circuit board closing the switch case.

In a preferred embodiment, the control circuit includes a semiconductor device and a plurality of circuit components connectable to the semiconductor device for controlling its operation, the circuit components being connectable to the semiconductor device via said switching operation performed by said at least one moving contact member in conjunction with said at least one of the switch contacts.

More preferably, the electrical switch includes a plurality of said at least one moving contact member in the same quantity as the plurality of circuit components, each for connecting a respective circuit component to the semiconductor device.

In a preferred construction, said at least one moving contact member comprises a first moving contact member and a second moving contact member, each for said switching operation with a respective one of the switch contacts, the first and second moving contact members extending side-by-side in substantially the same direction with their first ends being integrally inter-connected.

In another preferred construction, said at least one moving contact member comprises a first moving contact member and a second moving contact member, each for said switching operation with a respective one of the switch contacts, the first and second moving contact members extending apart in opposite directions with their first ends being integrally inter-connected.

More preferably, the electrical switch includes a plurality of said first moving contact members extending side-by-side in substantially the same first direction with their first ends being integrally inter-connected, and a plurality of said second moving contact members extending side-by-side in substantially the same second direction with their first ends being integrally inter-connected, the first and second directions being opposite directions.

According to a second aspect of the invention, there is provided an electrical switch comprising a switch body having upper and lower body interiors, a plurality of actuators in the upper body interior, a plurality of switch contacts provided in the lower body interior, and at least one moving contact member having first and second ends and provided in the lower body interior. Included are a plurality of elongate cam sliders extending side-by-side in the switch body between the actuators and said at least one moving contact member for sliding along their length by the actuators to act upon and cause pivotal movement of said at least one moving contact member about its first end such that its second end is moved into and out of contact with at least one of the switch contacts to perform switching operation. Said at least one moving contact member extends from its first end to its second end in a general direction substantially parallel to the length of the cam sliders.

Preferably, the electrical switch incorporates a control circuit provided on a circuit board which is fixed to the switch body.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
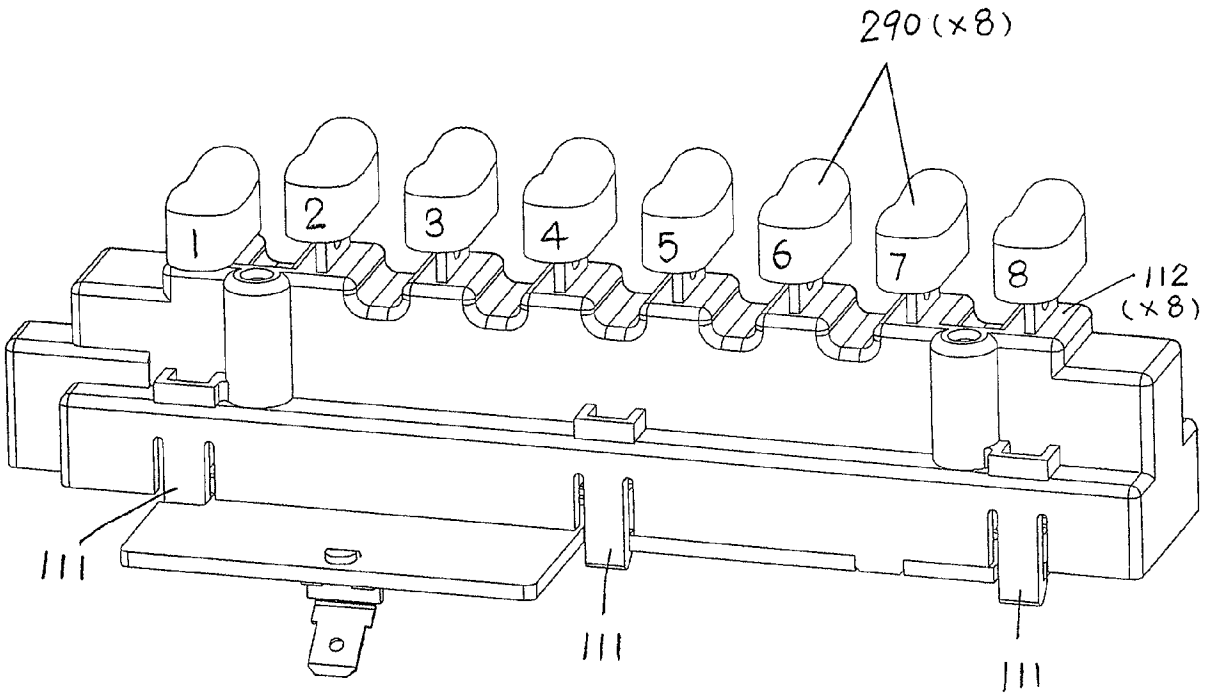
FIG. 1 is a perspective view of an embodiment of an electrical switch in accordance with the invention.

Referring to the drawings, there is shown an electrical switch 10 embodying the invention, which is generally known as a keyboard switch for controlling the operation of an electrical appliance such as a food processor or the like that is capable of operation in different modes, for example running at different speeds (in one direction or reversed) as well as momentary operation upon simple user's action and especially pressing of a button.

The keyboard switch 10 has an elongate switch body 100, a row of eight evenly spaced actuators 200 (i.e. 210 to 280 from left to right in FIG. 3) each being fitted with a button knob 290 in the upper body interior of the switch body 100, and a pair of switch terminals 310 and 320 in the lower body interior of the switch body 100. Internally of the switch body 100 and in the lower body interior thereof, there are two first and second moving contact members 400 and 600 and a fixed contact system 800 immediately underneath the moving contact members 400 and 600.

Also included internally is a stack of seven elongate cam slider blades 500 (i.e. 500A to 500G from front to back in FIG. 3) which extend side-by-side horizontally through the space between the actuators 200 and the moving contact members 400 and 600 for sliding by the actuators 200 lengthwise, i.e. along their length, in opposite left and right directions to move at least one part of the moving contact members 400 and/or 600 into or out of contact with the fixed contact system 800, thereby performing one or more switching operations.

The switch body 100 has at least two, upper and lower body parts, namely an oblong upper switch case 110 and a rectangular lower terminal board 120 closing the switch case 110 from below. The switch case 110 has six hooks 111 depending integrally from its bottom rim, which snap fit upon and around the periphery of the terminal board 120 such that the board 120 is tightly assembled with the switch case 110.

Figure 2:
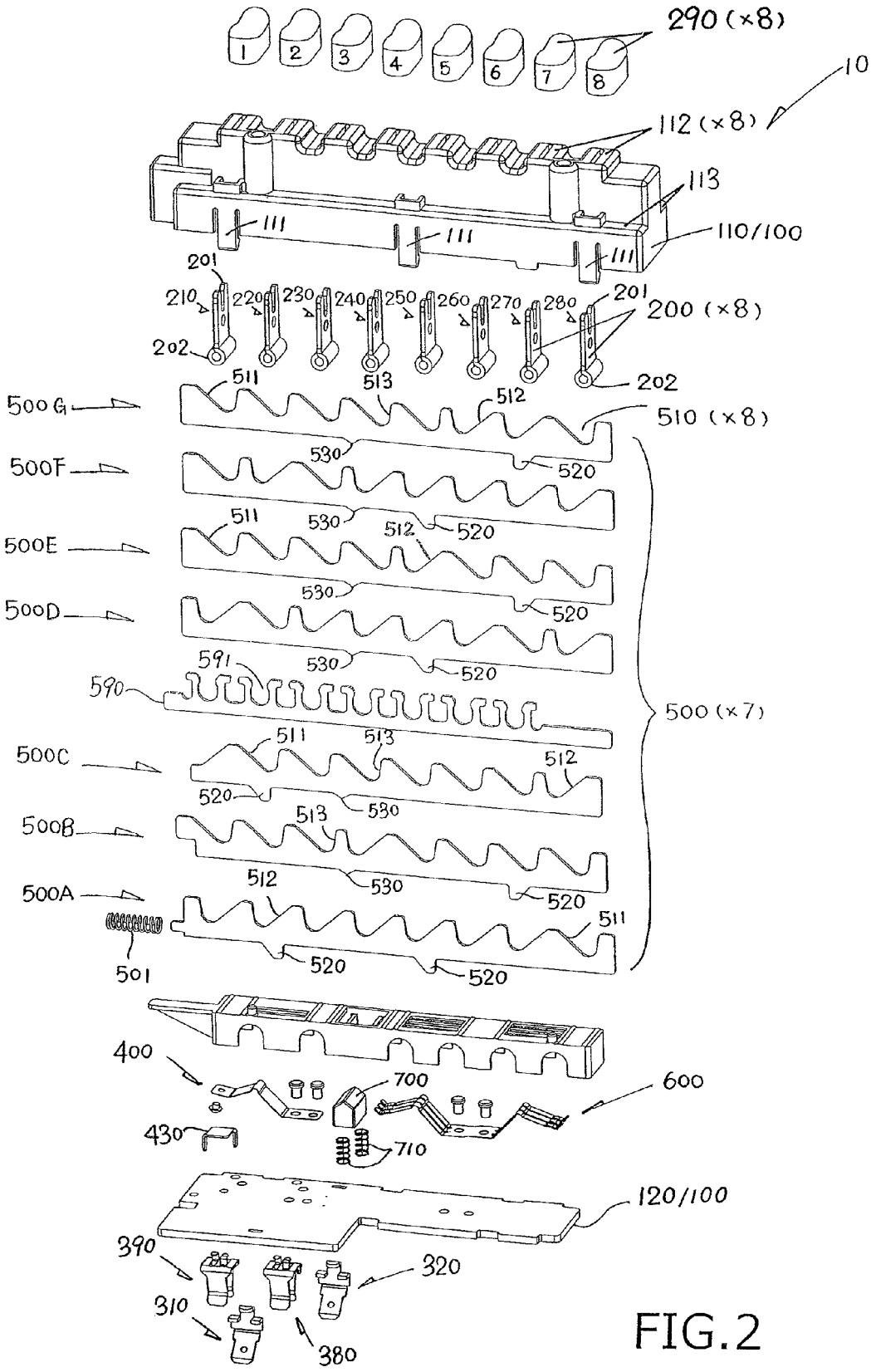
FIG. 2 is an exploded perspective view of the electrical switch of FIG. 1, showing most of its various parts and components.
Figure 8:
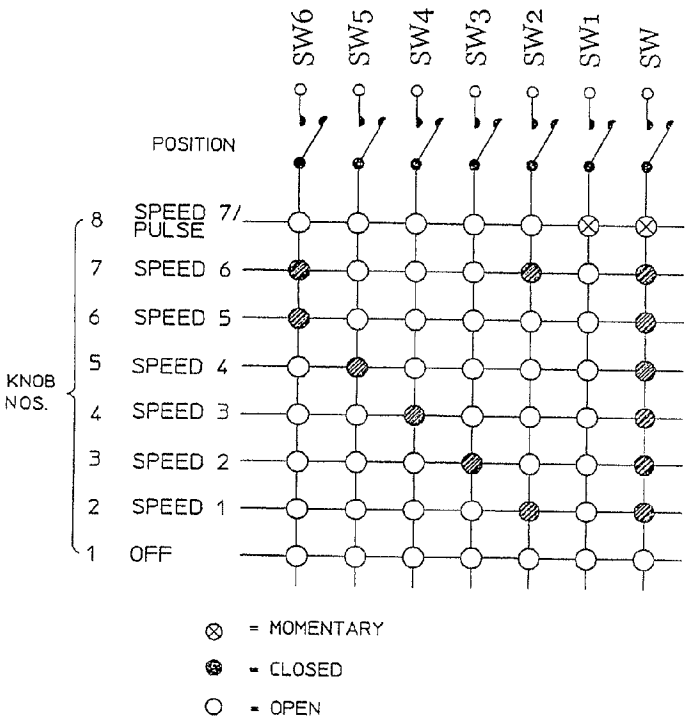
FIG. 8 is a schematic diagram showing the switching circuit design of the electrical switch of FIG. 1.
Figure 9:
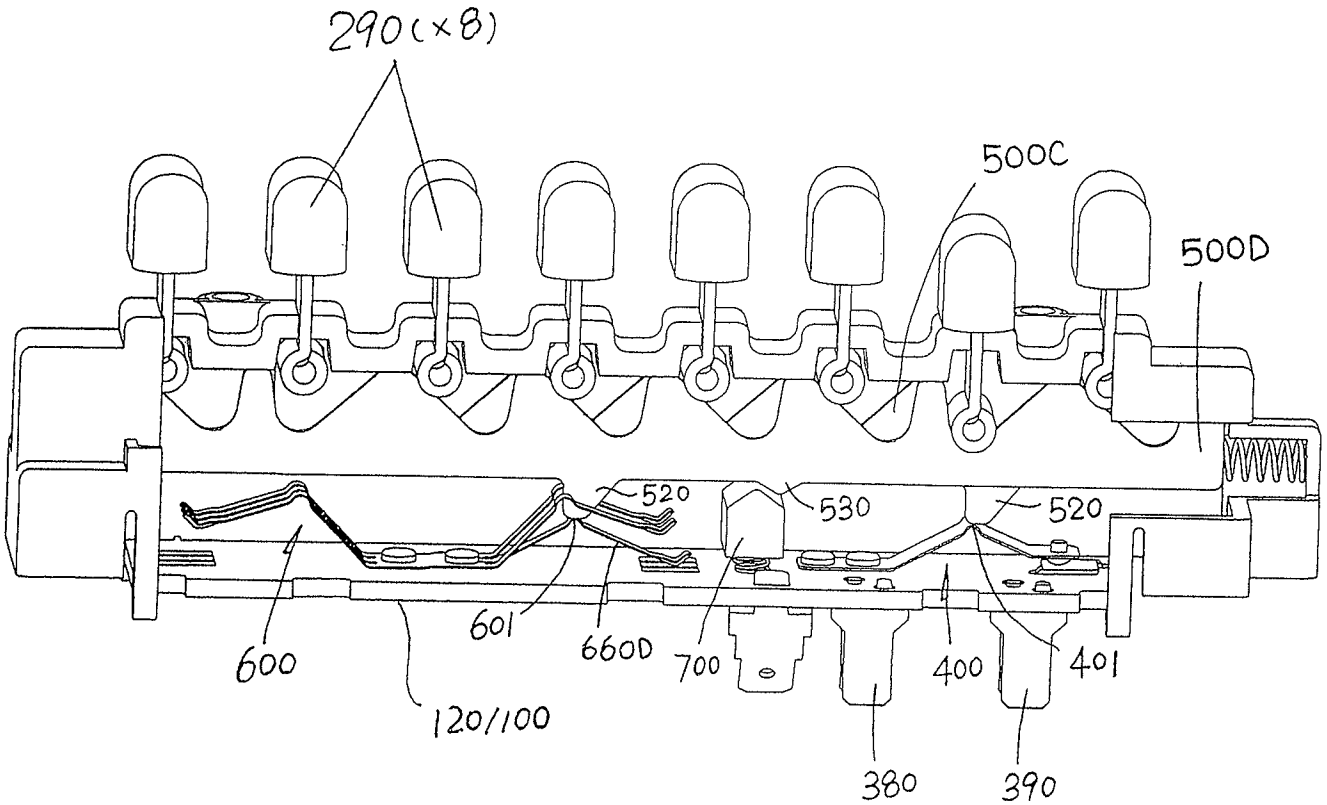
FIG. 9 is a partially cut-open perspective view of the electrical switch of FIG. 1.
Figure 10:
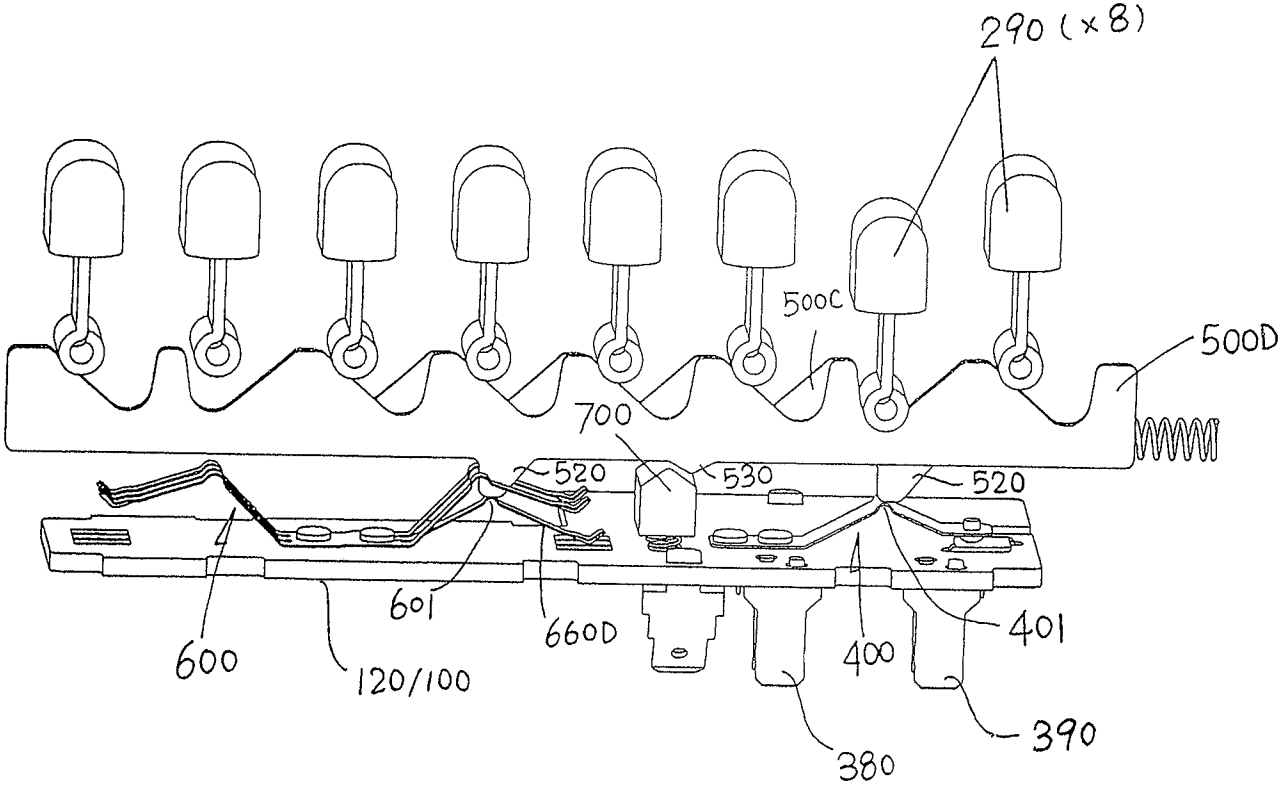
FIG. 10 is a simplified partially cut-open perspective view of the electrical switch of FIG. 9.

The switch case 110 is molded to have a row of eight regular chambers 112 centrally along its length, and a pair of longitudinally-extending shoulders 113 on opposite sides of the chambers 112. Each chamber 112 locates a respective actuator 200 partially therein for individual limited vertical sliding movement. Projecting out of the chambers 112, upper ends 201 of the actuators 200 are covered with respective button knobs 290 (knob nos. 1 to 8 in FIGS. 2 and 8), together forming a row of eight press keys resembling a keyboard for manual depression by a user to select various functions and/or speeds of a food processor or to stop it.

Electrical switches of the type concerned are typically a pure mechanical switch for connecting/disconnecting one or more circuit components, e.g. resistors, to/from a control circuit of the food processor, in that the control circuit is a distinct part from the electrical switch.

The electrical switch 10 of this particular embodiment incorporates a built-in control circuit 20 for direct control of the load e.g. an electric motor of the food processor. The control circuit 20 is provided on the terminal board 120 fixed to the switch body 100.

The terminal board 120 is implemented by a printed circuit board, designated by same reference numeral 120, having an upper surface (facing internally of the switch body 100) on which the fixed contact system 800 is printed as a set of copper pads interconnected by copper paths together constituting a conductor circuit to which various circuit components of the control circuit 20 are soldered.

The conducting pads include a pair of contact pads 801 and 802 to which the switch terminals 310 and 320 are attached respectively from below through the circuit board 120, another pair of contact pads 803 and 804 associated with the first moving contact member 400, and one contact pad 805 and six small contact pads 806 (i.e. 806A, 806B, 806D, 806E, 806F and 806G) associated with the second moving contact member 600. A pair of fuse clips 380 and 390 is attached, from below through the circuit board 120, to respective parts of the contact pads 802 and 803, to which an electrical fuse F1 is inserted bridging across the contact pads 802 and 803.

The first moving contact member 400 is provided by a copper strip having opposite ends 410 and 420, with the first end 410 being fixed by means of two rivets 412 directly on a part of the contact pad 804 and the second end 420 being free and fitted with a silver contact rivet 421 and extending to overlap with and directly above a part of the contact pad 803. A silver contact plate 430 is attached on the said part of the contact pad 803 for improved contact performance. The copper strip is bent slightly upwards at its first end 410 and then slightly downwards about an intermediate part at mid-length, where an upwardly-protruding part-circular bend 401 is formed, with its second end 420 being aligned with and cantilevered immediately above the contact plate 430 for the contact rivet 421 to make or break contact with the contact plate 430.

The moving contact member 400 is oriented with its first and second ends 410 and 420 lying on an imaginary plane which extends substantially parallel to the longitudinal extent or length of the cam slider blades 500. In other words, the moving contact member 400 extends from its first/fixed end 410 to its second/free end 420 in a general direction substantially parallel to the length of the slider blades 500.

The moving contact member 400 acts as a generally flat inverted V-shaped contact lever which is arranged to be pressed at its bend 401 to pivot downwards against its own resiliency for contact making, and is subsequently self-pivotable upwards by virtue of its own resiliency upon release for contact breaking. The contact making and breaking between the contact rivet 421 (connected to the contact pad 804) and the contact plate 430 (connected to the contact pad 803) constitutes a normally-open main switch SW across the two contact pads 804 and 803.

The second moving contact member 600 is provided by another relatively larger copper strip which has a central part 610 and six fingers or contact levers 660 (i.e. 660A, 660B, 660D, 660E, 660F and 660G) projecting out in a co-parallel manner from opposite left and right sides of the central part 610, three on each side and overall in a generally symmetrical manner. The central part 610 is secured by means of two rivets 612 directly on the contact pad 805, with the six levers 660A, 660B, 660D, 660E, 660F and 660G extending in opposite directions to overlap with and directly above the contact pads 806A, 806B, 806D, 806E, 806F and 806G respectively.

The contact levers 660 are each bent slightly upwards from the central part 610 and then slightly downwards about an intermediate part at mid-length, where an upwardly-protruding part-circular bend 601 is formed, with their free ends 661 being aligned with and cantilevered immediately above the corresponding contact pads 806 for making or breaking contact therewith.

Each contact lever 660 is oriented with its opposite ends lying on an imaginary plane which extends substantially parallel to the longitudinal extent or length of the cam slider blades 500. Thus, the lever 660 extends from its first/fixed end adjoining the central part 610 to its second/free end 661 in a general direction substantially parallel to the length of the slider blades 500.

Each lever 660 acts as a generally flat inverted V-shaped contact lever which may be pressed at its bend 601 to pivot downwards against its own resiliency for contact making, and is subsequently self-pivotable upwards by virtue of its own resiliency upon release for contact breaking. The contact making and breaking between its free end 661 (connected to the contact pad 805 via the central part 610) and the individual contact pad 806 constitutes a normally-open subsidiary switch across the two contact pads 805 and 806.

There are altogether six such individual switches SW1 to SW6 which incorporate the contact pad 805 and contact pads 806A to 806G respectively and are associated with resistors R3 to R8 in the following relationship:

| Subsidiary Switches | Contact Pads | Resistors |
|---|---|---|
| SW1 | 805, 806A | R3 |
| SW2 | 805, 806D | R4 |
| SW3 | 805, 806F | R5 |
| SW4 | 805, 806B | R6 |
| SW5 | 805, 806E | R7 |
| SW6 | 805, 806G | R8 |

Figure 5:
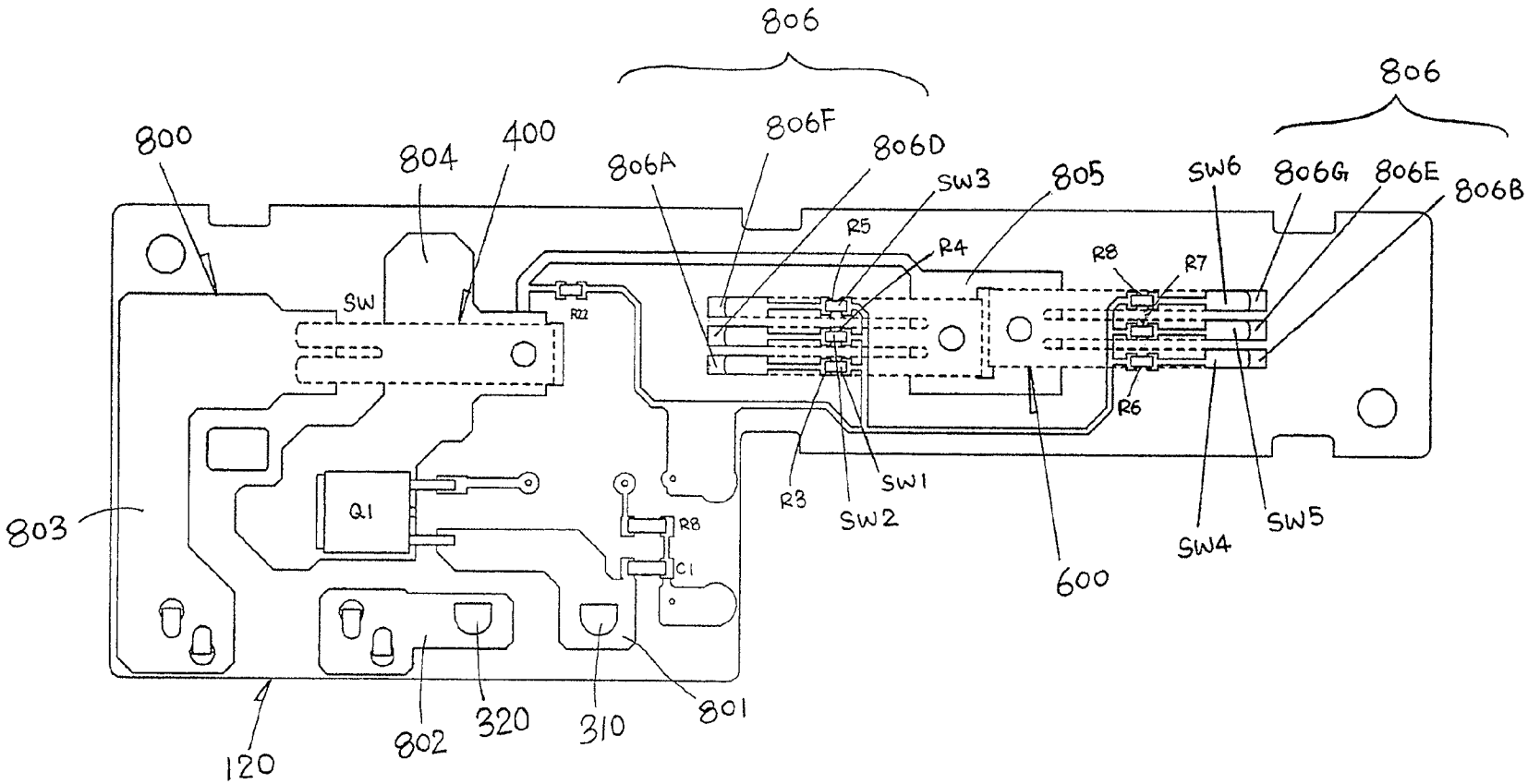
FIG. 5 is a top plan view of the circuit board with fixed and moving contacts thereon of FIG. 3, including a control circuit.
Figure 6:
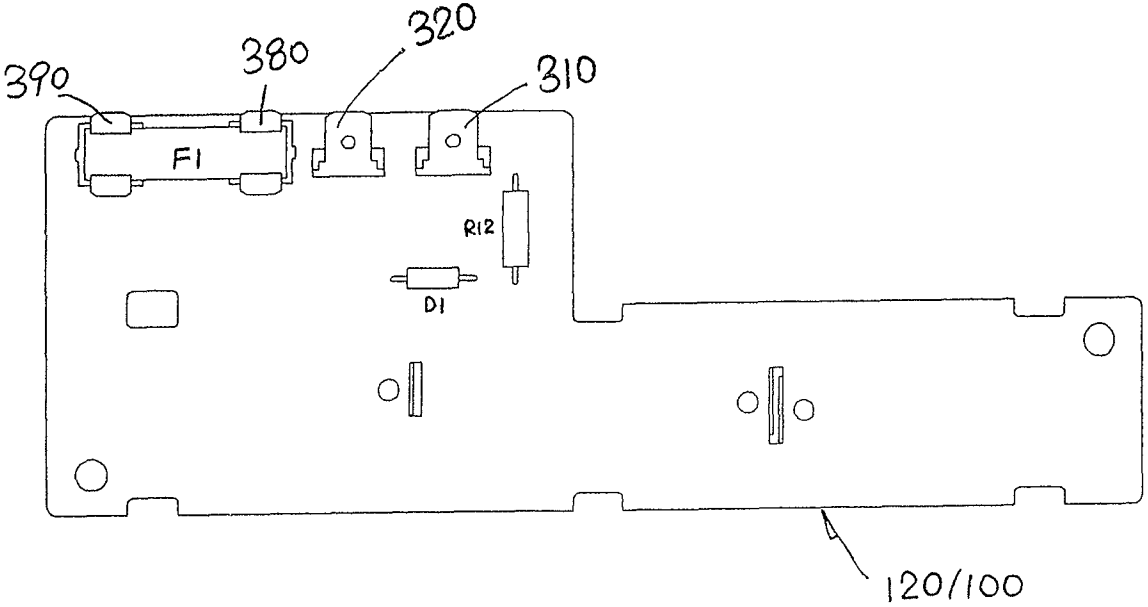
FIG. 6 is a bottom plan view of the circuit board of FIG. 5.
Figure 7:
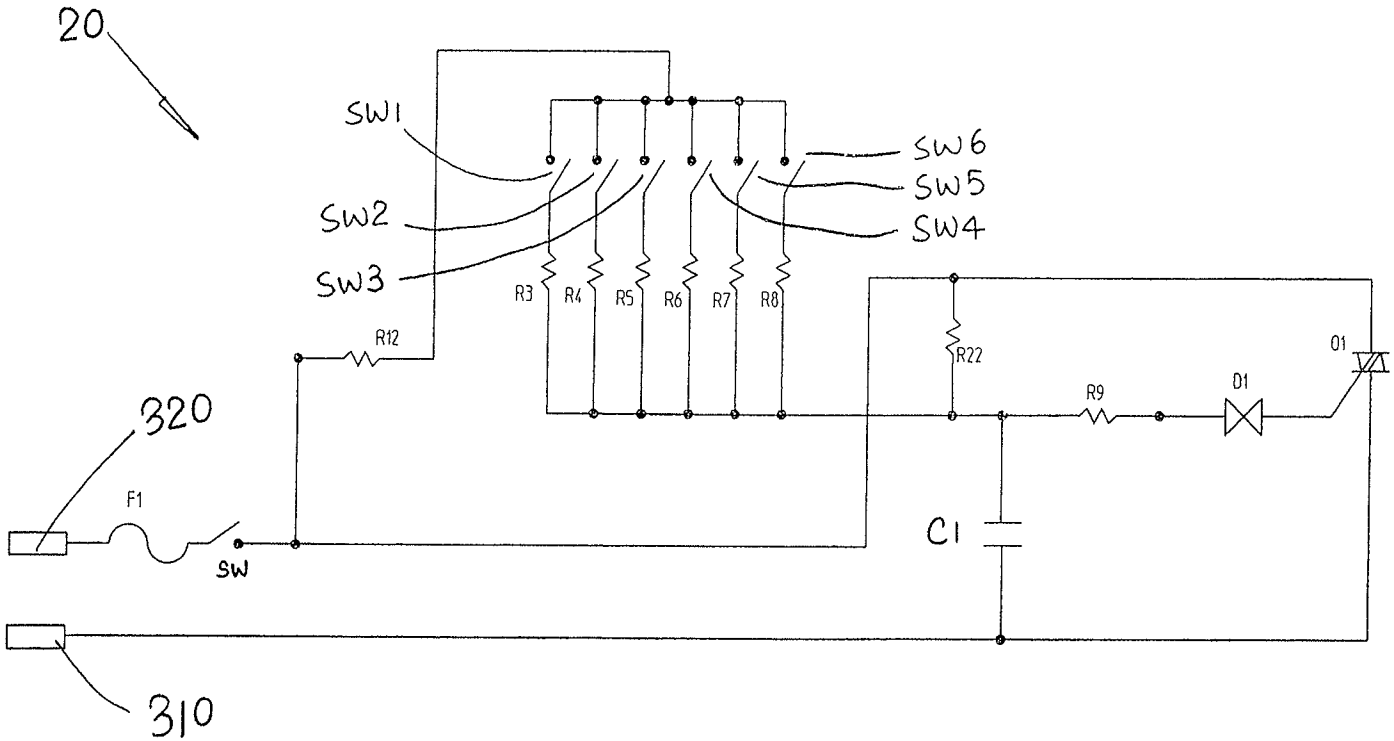
FIG. 7 is a schematic circuit diagram of the control circuit of FIG. 5.

The resistors R3 to R8 are surface-mounted onto the circuit board 120 at positions directly underneath the contact levers 660A, 660D, 660F, 660B, 660E and 660G respectively (FIG. 5). Each resistor R3/R4/R5/R6/R7/R8 is attached across a pair of small conducting pads connected in series with the respective contact lever 660 for connection or disconnection by the corresponding subsidiary switch SW1/SW2/SW3/SW4/SW5/SW6 during operation of the control circuit 20.

Overall, the second moving contact member 600 resembles a spider or crab by having its crooked levers 660 sticking out from opposite sides of its central part 610. Individually, each lever 660 has a similar configuration as the first moving contact member 400 and operates in substantially the same manner as a normally-open electrical switch. The first moving contact member 400 is the basic configuration, and the second moving contact member 600 is a combination of six of the first moving contact member 400.

Referring specifically to the second moving contact member 600, it has at least two contact levers e.g. 660A and 660D, each being equivalent to the first moving contact member 400 and for switching operation with a respective contact pad 806A or 806D. These two contact levers 660A and 660D extend side-by-side in substantially the same direction (to the left), with their first/fixed ends being integrally inter-connected via the central part 610.

From another perspective, this moving contact member 600 has at least two contact levers e.g. 660A and 660B, each being equivalent to the first moving contact member 400 and for switching operation with a respective contact pad 806A or 806B. These two contact levers 660A and 660B extend apart in opposite directions (to the left and right), with their first/fixed ends being integrally inter-connected via the central part 610.

In general, the moving contact member 600 has a plurality of e.g. three left contact levers 660A, 660D and 660F (each being equivalent to the first moving contact member 400) extending side-by-side in substantially the same first direction to the left with their first/fixed ends being integrally inter-connected, and a plurality of e.g. three right contact levers 660B, 660E and 660G (each likewise being equivalent to the first moving contact member 400) extending side-by-side in substantially the same opposite second direction to the right with their first/fixed ends being integrally inter-connected.

Figure 3:
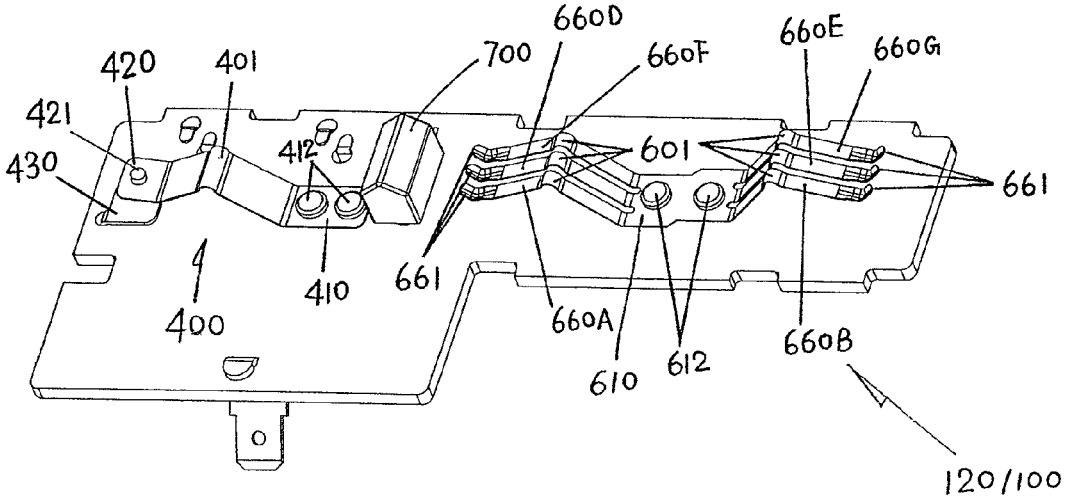
FIG. 3 is a perspective view of a circuit board with fixed and moving contacts thereon of the electrical switch of FIG. 1.
Figure 4:
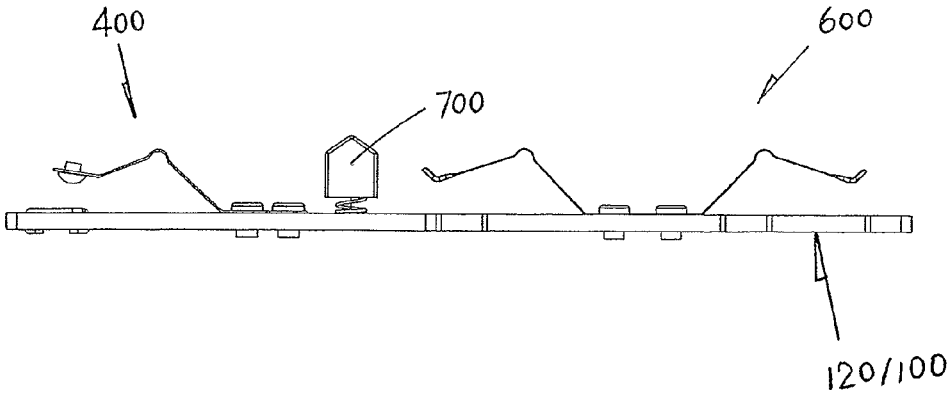
FIG. 4 is a side view of the circuit board with fixed and moving contacts thereon of FIG. 3.

Turning now to the slider blades 500, each in general has a row of eight upper recesses 510 at equal intervals along its upper edge and, with the exception of the first slider blade 500A, one cam part 520 depending from its lower edge at a position in vertical alignment with one of the upper recesses 510, as shown in FIG. 3. At another position vertically aligned with about halfway between the $3^{rd}$ and $4^{th}$ upper recesses 510, on the lower edge there is also a relatively small triangular tooth 530. The first slider blade 500A has two such cam parts 520 at positions vertically aligned with the $2^{nd}$ and $5^{th}$ upper recesses 510, and lacks a said tooth.

The upper recesses 510 are generally aligned as between adjacent blades 500. Within each stack of aligned upper recesses 510, a corresponding actuator 200 acts by its bottom end 202 upon opposite sides (especially inclined sides) of the recesses 510, through a cam action where appropriate. Each of the actuator ends 202 is generally cylindrical about a horizontal axis back-to-front and has an axial length long enough to span across the entire stack of slider blades 500.

The following applies to all of the slider blades 500. One of the opposite sides of each upper recess 510 may be either a 45°-inclined left side 511 for the slider blade 500 concerned to be slid along its length to the left through a cam action by an associated actuator 200 pressed down using its bottom end 202, or a 45°-inclined right side 512 for the slider blade 500 to be slid lengthwise to the right. The other of the opposite sides is a flat vertical side 513 for involving no cam action. The leftmost recess 510 of the third slider blade 500C lacks such a flat vertical side, by reason of having an open left side.

All the slider blades 500 are slidable to the left and right for a distance generally equal to or no longer than the width of one recess 510, because each slider blade 500 is slidable by one of the actuators 200 lowered into and functioning within the corresponding recess 510 and hence the opposite end positions of the blade 500 is set by either the leftmost or rightmost side of the recess 510 reaching the actuator 200.

Thus in general, each slider blade 500 is slidable back-and-forth by one recess width between two positions, upon pressing of one actuator 200 and subsequently another actuator 200.

Whilst the first slider blade 500A is resiliently biased to slide in the right direction by means of a compression coil spring 501, all the other slider blades 500B to 500G are individually free to slide to the left or right and stay put in one of two stable positions. The first blade 500A has only one stable position on the right, and is momentarily slid to the left for as long as the $8^{th}$ knob 290 or last actuator 280 is being depressed, against the action of the spring 501. The $8^{th}$ knob is for momentary or pulse operation of the food processor.

A pointed plunger 700 spring-loaded upwards by a pair of springs 710 from the circuit board 120 below but offset from where the teeth 530 of the slider blades 500 are (i.e. between the $3^{rd}$ and $4^{th}$ recesses 510) provides a resilient barrier for the tooth 530 of a sliding blade 500 (save the first blade 500A having no such a tooth) to ride over, whereby holding the blade 500 in the new position against unintentional return to the original position.

There is an extra blade 590, which is stationary or fixed and in any event not slidable, stacked between the third and fourth slider blades 500C and 500D. This blade 590 has a row of seven notches 591 in vertical alignment with the $1^{st}$ to $7^{th}$ actuators 210 to 270 respectively, and no such a notch is provided for the last actuator 280. Each notch 591 acts as a resiliently deformable circlip for receiving and retaining the bottom end 202 of an aligned actuator 200 whenever the aligned actuator 200 is pressed down to slide one or more of the slider blades 500 as described above, thereby holding that actuator 200 down to maintain the position of the slid blade(s) 500 in the new position. The actuator 200 is able to escape upon being lifted by a different slider blade 500, through reversed cam action, operated by another actuator 200.

The slider blades 500 extend horizontally through between the actuators 200 above and the moving contact members 400 and 600 below, for sliding along their length by the actuators 200 in opposite left and right directions. Upon sliding in one direction and then reversed, the or each slider blade 500 concerned will operate one or more of the main and subsidiary switches SW and SW1 to SW6 by firstly acting upon and causing pivotal movement of the switches' contact levers 400 and 660 and subsequently releasing them for their self-return.

The switches SW and SW1 to SW6 are arranged in a series of three sections directly underneath and along the length of the slider blades 500, with the main switch SW (i.e. moving contact member 400) in the left section, a first group of three subsidiary switches SW1 to SW3 (i.e. contact levers 660A, 660D and 660F) in the middle section and a second group of the remaining three subsidiary switches SW4 to SW6 (i.e. contact levers 660B, 660E and 660G) in the right section.

The main switch SW is closed by the bend 401 of its moving contact member 400 being pressed downwards by at least one or both of the aligned cam parts 520 of the slider blades 500A and 500C, and will re-open upon departure of the cam part(s). The bend 401 protrudes upwardly from the rest of the moving contact member 400 towards the slider blades 500A and 500C, being a protrusion for and facilitating acting upon by the slider blades' cam parts 520.

The subsidiary switches SW1 to SW6 are individually closed by the bends 601 of their contact levers 660A, 660D, 660F, 660B, 660E and 660G being pressed downwards by the aligned cam parts 520 of the slider blades 500A, 500D, 500F, 500B, 500E and 500G respectively, and will re-open upon departure of the corresponding cam parts. The bends 601 protrude upwardly from the rest of the contact levers 660 towards the slider blades 500, being protrusions for and facilitating acting upon by the slider blades' cam parts 520.

The moving contact member 400 of the main switch SW is pivoted at its right end 410 and extends from its right end 410 to its left end 420 in the left general direction to the left. Similarly, the contact levers 660A, 660D and 660F of the first group of the subsidiary switches SW1 to SW3 are also pivotable about their right ends (adjoining the central part 610) and extend from their right ends to their free left ends 661 in the left general direction to the left. On the contrary, the contact levers 660B, 660E and 660G of the subsidiary switches SW4 to SW6 of the second group are pivoted at their opposite left ends (adjoining the central part 610) and extend from their left ends to their free right ends 661 in the opposite right general direction to the right.

The cam parts 520 for operating the main and subsidiary switches SW and SW1 to SW3 have an inclined left side (i.e. edge or surface) for approaching and bearing upon the bends 401 and 601 of these switches SW and awl to SW3 from the right, in the same (i.e. left) general direction as that in which their moving contact member 400 and contact levers 660A, 660D and 660F extend. The cam parts 520 for operating the remaining subsidiary switches SW4 to SW6 have an inclined right side (i.e. edge or surface) for approaching and bearing upon the bends 601 of these switches SW4 to SW6 from the left, in the same (i.e. right) general direction as that in which their contact levers 660B, 660E and 660G extend.

By being approached and acted upon in the same general direction in which they extend from their fixed end to their free end, the pivoted moving contact member 400 and contact levers 660A to 660G are only subject to tensile strain (in a direction from their pivoted ends) which will indeed assist their intended downward pivotal movement, without there being any compressive strain which otherwise will to a certain extent counteract their intended pivotal movement and unnecessarily strain their point of pivot.

Referring now to the control circuit 20, all of its components are mounted or soldered on the printed circuit board 120. The circuit components include the main switch SW, which is formed by the moving contact member 400 and the contact pads 803/804 and plate 430, and the subsidiary switches SW1 to SW6, which are formed by the contact levers 660 and contact pads 805/806. The main switch SW is connected in series with the fuse F1 at the switch terminal 320, for live AC connection.

The key component is a semiconductor device provided by a triac Q1 which has two main terminals connected to the switch terminals 310 and 320 respectively and includes a gate electrode to which a diac D1 is connected for trigger. The triac Q1 will conduct current in either direction (i.e. for AC operation) when it is triggered or turned on by either a positive or negative current applied to its gate electrode, via the diac D1, until the current drops below a certain threshold or the holding current. Other circuit components include resistors R3 to R8, R9, R12 and R22 and capacitor C1 for controlling the operation of the triac Q1.

The resistors R3 to R8, which among themselves are connected in parallel, are connected to the diac D1 for applying a voltage thereto via the capacitor C1. The resistors R3 to R8 are connected in series with the subsidiary switches SW1 to SW6 respectively. The switches SW1 to SW6 select which one or more of the resistors R3 to R8 are connected for triggering of the triac Q1. The connected resistor(s) R3/R4/R5/R6/R7/R8 controls the charging rate of the capacitor C1 and hence determines when the capacitor voltage exceeds or reaches the breakover voltage for turning on the diac D1, and in turn the firing angle of the triac Q1. The duty cycle of conduction of the triac Q1 is hence controlled, which determines, inter alia, the speed of the motor driving the food processor.

It is noted that there are although six contact levers 600 (which are by nature moving contact members) and the same number/quantity of resistors R3 to R8, one contact lever 660 for connecting and disconnecting a respective resistor R3/R4/R5/R6/R7/R8 relative to the triac Q1.

The electrical switch 10 is connected with its terminals 310 and 320 in series with the electric motor of the food processor across the live and neutral terminals of the AC mains supply. To operate the food processor, the user is to press one of the knobs #2 to #8 of the electrical switch 10 to close (i.e. turn ON) the main and relevant subsidiary switches in order to run the electric motor in the desired mode.

In operation, the relationship between the status of the main and subsidiary switches SW and SW1 to SW6, the slider blades 500 whose cam parts 520 turn ON such switches and the actuators 200 which operate the slider blades 500 is shown in the following table:

| Actuators (Knobs) | Mode of Operation | Slider Blades | Main Switch ON | Sub. Switches ON | Resistors connected |
|---|---|---|---|---|---|
| 280 (#8) | Pulse Speed 7 | 500A | ✓ | SW1 | R3 |
| 270 (#7) | Speed 6 | 500C, 500D, 500G | ✓ | SW2, SW6 | R4, R8 |
| 260 (#6) | Speed 5 | 500C, 500G | ✓ | SW6 | R8 |
| 250 (#5) | Speed 4 | 500C, 500E | ✓ | SW5 | R7 |
| 240 (#4) | Speed 3 | 500C, 500B | ✓ | SW4 | R6 |
| 230 (#3) | Speed 2 | 500C, 500F | ✓ | SW3 | R5 |
| 220 (#2) | Speed 1 | 500C, 500D | ✓ | SW2 | R4 |
| 210 (#1) | OFF | 500F | x | SW3 | R5 |

For the sake of clarity, a detailed explanation of the above relationship is not given herein, which would nonetheless be apparent to a person of ordinary skill in the art by reference to the relative position between the actuators 200, the slider blades 500 with their cam parts 520, the moving contact member 400 of the main switch SW and contact levers 660 of the subsidiary switches SW1 to SW6, and the resistors R3 to R8 connected in the control circuit 20.

As an example, upon pressing the knob #4 will set the electric motor to run at speed 3 by sliding the slider blade 500C to the left to close the main switch SW (i.e. turning on the mains power) and the slider blade 500B to the right to close the subsidiary switch SW4 and hence connect the resistor R6 to the triac Q1 in the control circuit 20. Subsequent pressing of, say, the knob #7 will return the slider blade 500B (i.e. disconnecting the resistor R6), keep the slider blade 500C in position (i.e. keeping the mains power on), and slide the slider blades 500D and 500G to the left and right respectively to close the subsidiary switches SW2 an SW6 respectively and hence connect the resistors R4 and R8 to the triac Q1 in the control circuit 20 for setting the electric motor to run at speed 6. Finally, pressing of the knob #1 will return both of the slider blades 500D and 500G and, in particular, slide the slider blade 500C to the right to re-open the main switch SW, thereby turning off the mains power.

It is envisaged that any other suitable types of semiconductor device can be used in the control circuit for controlling the operation of an intended electrical appliance, such as SCR (i.e. silicon-controlled rectifier) for DC motor operation.

The invention has been given by way of example only, and various other modifications of and/or alterations to the described embodiment may be made by persons skilled in the art without departing from the scope of the invention as specified in the appended claims.

What is claimed is:

1. An electrical switch comprising:

a switch body having upper and lower body interiors;

a plurality of actuators located in the upper body interior;

a plurality of switch contacts located in the lower body interior;

a plurality of first moving contact members having first and second ends, switching respective switch contacts, located in the lower body interior, and extending side-by-side, substantially in a first direction, with the first ends of the first moving contact members integrally inter-connected, and a plurality of second moving contact members having first and second ends, switching respective switch contacts, located in the lower body interior, and extending side-by-side substantially in a second direction, with the first ends of the second moving contact members integrally inter-connected, wherein the first and second directions are opposite directions; and a plurality of elongate cam sliders extending side-by-side in a plane of longitudinal extent in the switch body, located between the actuators and the pluralities of first and second moving contact members, for sliding lengthwise by the actuators to act upon and cause pivotal movement of the pluralities of first and second moving contact members, about the first ends of the pluralities of first and second moving contact members, so that the second ends of the pluralities of first and second moving contact members are moved into and out of contact with at least one of the switch contacts, wherein the first and second ends of the pluralities of first and second moving contact members lie in a plane extending substantially parallel to the plane of the longitudinal extent of the cam sliders.

2. The electrical switch as claimed in claim 1, wherein the pluralities of first and second moving contact members have intermediate parts located between the first and second ends, and the pluralities of first and second moving contact members are acted upon, about the intermediate parts, by at least one of the cam sliders.

3. The electrical switch as claimed in claim 2, wherein the pluralities of first and second moving contact members are bent about the intermediate parts.

4. The electrical switch as claimed in claim 2, wherein the intermediate parts of the pluralities of first and second moving contact members comprise a protrusion acted upon by at least one of the cam sliders.

5. The electrical switch as claimed in claim 3, wherein the pluralities of first and second moving contact members have a generally planar inverted V-shape.

6. The electrical switch as claimed in claim 1, wherein the second ends of the pluralities of first and second moving contact members are positioned directly opposite the switch contacts.

7. The electrical switch as claimed in claim 1, wherein at least one of the cam sliders has a cam part for acting upon at least one of the contact members of the pluralities of first and second moving contact members, and the cam part is arranged to approach and act upon at least one of the contact members of the pluralities of first and second moving contact members in a direction parallel to a direction in which the pluralities of first and second moving contact members extend from the first end to the second end.

8. The electrical switch as claimed in claim 7, wherein the cam part has an inclined side for approaching and acting upon at least one of the contact members of the pluralities of first and second moving contact members.

9. The electrical switch as claimed in claim 1, comprising a circuit board on which the switch body is mounted and a control circuit mounted on the circuit board.

10. The electrical switch as claimed in claim 9, wherein the switch contacts are located on the circuit board, the pluralities of first and second moving contact members are mounted on the circuit board, and the switch contacts and the pluralities of first and second moving contact members are part of the control circuit.

11. The electrical switch as claimed in claim 9, wherein the switch body comprises a switch case and the circuit board, with the circuit board closing the switch case.

12. The electrical switch as claimed in claim 9, wherein the control circuit includes a semiconductor device and a plurality of circuit components connectable to the semiconductor device for controlling operation of the semiconductor device, and the circuit components are connectable to the semiconductor device via the pluralities of first and second moving contact members and at least one of the switch contacts.

13. The electrical switch as claimed in claim 12, the first and second moving contact members are equal in number to the plurality of circuit components, each first and second moving contact member connecting a respective circuit component to the semiconductor device.

* * * * *